US010927806B2

(12) United States Patent
Florijancic et al.

(10) Patent No.: US 10,927,806 B2
(45) Date of Patent: Feb. 23, 2021

(54) SOLENOID DRIVE FOR A STARTER FOR AN INTERNAL COMBUSTION ENGINE

(71) Applicant: Mahle International GmbH, Stuttgart (DE)

(72) Inventors: Tadej Florijancic, Most na Soci (SI); Dejan Manfreda, Kal nad Kanalom (SI)

(73) Assignee: Mahle International GmbH

( * ) Notice: Subject to any disclaimer, the term of this patent is extended or adjusted under 35 U.S.C. 154(b) by 118 days.

(21) Appl. No.: 15/995,107

(22) Filed: May 31, 2018

(65) Prior Publication Data

US 2018/0347536 A1 Dec. 6, 2018

(30) Foreign Application Priority Data

Jun. 1, 2017 (EP) ..... 17174017

(51) Int. Cl.
*H01F 7/16* (2006.01)
*F02N 11/08* (2006.01)
(Continued)

(52) U.S. Cl.
CPC ..... *F02N 11/0859* (2013.01); *F02N 11/087* (2013.01); *F02N 11/0851* (2013.01);
(Continued)

(58) Field of Classification Search
CPC ..... H01F 7/081; H01F 7/16; H01F 7/1607
See application file for complete search history.

(56) References Cited

U.S. PATENT DOCUMENTS 6,392,516 B1 * 5/2002 Ward ..... H01F 7/081 335/220
8,248,193 B2 8/2012 Kaneda et al.
(Continued)

FOREIGN PATENT DOCUMENTS

DE 102009052938 A1 11/2010
DE 102011086201 A1 5/2013
(Continued)

*Primary Examiner* — Ramon M Barrera
(74) *Attorney, Agent, or Firm* — Fishman Stewart PLLC

(57) ABSTRACT

A solenoid drive may include a ferromagnetic housing having a coil receiving chamber axially limited by opposing face side walls, a cylindrical coil arrangement having at least one electric coil, the coil arrangement being arranged in the chamber and coaxially surrounding a cylindrical coil interior space, a ferromagnetic plunger stop having a central region projecting axially in the interior space, a ferromagnetic plunger arranged at the housing opposing the plunger stop, and a ferromagnetic bypass device extending in a circumferential direction and arranged coaxially with respect to the coil arrangement and radially within the coil. The plunger may project axially into the coil interior space and may be adjustable axially bi-directionally relative to the housing between active and distal positions, which are proximal and distal, respectively, with respect to the central region. The bypass device may be spaced apart axially from the face side walls. In the passive position, the plunger may project axially into the bypass device such that an axial overlap between the plunger and the bypass device may be defined.

20 Claims, 6 Drawing Sheets

(51) Int. Cl.

| | |
|---|---|
| ***F02N 15/00*** | (2006.01) |
| ***H01F 7/08*** | (2006.01) |
| ***H01F 7/121*** | (2006.01) |
| ***F02N 15/06*** | (2006.01) |
| *H01H 51/06* | (2006.01) |

(52) U.S. Cl.

CPC ..... *F02N 15/006* (2013.01); *F02N 15/067* (2013.01); *H01F 7/081* (2013.01); *H01F 7/121* (2013.01); *H01F 7/1607* (2013.01); *F02N 15/062* (2013.01); *F02N 2011/0874* (2013.01); *F02N 2011/0892* (2013.01); *F02N 2015/061* (2013.01); *H01H 51/065* (2013.01)

(56) References Cited

U.S. PATENT DOCUMENTS

| | | | |
|---|---|---|---|
| 8,421,565 | B2 | 4/2013 | Santichen et al. |
| 9,476,389 | B2 | 10/2016 | Amaral et al. |
| 2010/0271155 | A1 | 10/2010 | Kaneda et al. |

FOREIGN PATENT DOCUMENTS

| | | | |
|---|---|---|---|
| EP | 2858075 | A1 | 4/2015 |
| EP | 3184804 | A1 | 6/2017 |
| WO | 2015072770 | A1 | 5/2015 |

* cited by examiner

SOLENOID DRIVE FOR A STARTER FOR AN INTERNAL COMBUSTION ENGINE

CROSS-REFERENCE TO RELATED APPLICATIONS

This application claims priority to European Patent Application No.: EP 17174017.8 filed on Jun. 1, 2017, the contents of which are incorporated herein by reference.

TECHNICAL FIELD

The present invention relates to a solenoid drive for a starter of an internal combustion engine with the features of the preamble of claim 1. The invention also relates to a starter for an internal combustion engine, which starter is equipped with such a solenoid drive. The invention refers also to a method for operating a solenoid drive.

BACKGROUND

A starter of this type comprises a support, an electric motor which is arranged on the support and which serves for driving a pinion in rotation, and a solenoid drive which is arranged on the support and which serves for the axial adjustment of the pinion between an engagement position, which is provided for the drive of a gearwheel of the internal combustion engine, and a non-engagement position, which is offset axially with respect to the engagement position.

The solenoid drive used here comprises a ferromagnetic housing and a cylindrical coil arrangement which has at least one electric coil, wherein the coil arrangement is arranged in the housing and coaxially surrounds a cylindrical coil interior space. Furthermore, a ferromagnetic plunger stop is provided which is arranged at a first axial end of the coil arrangement in the housing and which has a central region projecting axially into the coil interior space. Finally, a ferromagnetic plunger is provided which, at a second axial end of the coil arrangement, which axial end is opposite the central region of the plunger stop, projects axially into the coil interior space, and which is arranged so as to be adjustable axially bi-directionally relative to the housing between an active position which is proximal with respect to the central region and a passive position which is distal with respect to the central region. The drive coupling between plunger and pinion takes place in such a manner that, in the passive position of the plunger, the pinion is in the non-engagement position while said pinion is transferred into the engagement position thereof by adjustment of the plunger into the active position.

For the starting of the internal combustion engine, the solenoid drive is activated so as to transfer the pinion of the starter from the non-engagement position into the engagement position. For this purpose, the plunger is adjusted from the passive position into the active position. In the engagement position, the pinion meshes with a gearwheel of the internal combustion engine, which may be formed for example on a flywheel of a drive train of the internal combustion engine. The electric motor then drives the pinion, which in turn drives said gearwheel, as a result of which a crankshaft of the internal combustion engine is set into rotation in order to start the internal combustion engine. As soon as the internal combustion engine has started and the crankshaft thereof is driven by reciprocating movements of pistons of the internal combustion engine, the solenoid drive is activated such that the pinion is returned again from the engagement position into the non-engagement position.

For this purpose, the plunger is adjusted back from the active position into the passive position. In the non-engagement position, the pinion disengages from said gearwheel, that is to say no longer meshes with the latter.

In order to be able to adjust the pinion from the non-engagement position into the engagement position and in order to be able to secure the pinion in the engagement position, the coil arrangement has to transmit comparatively large electromagnetic forces to the plunger in order to draw the latter into the coil interior space and hold said plunger therein, for the active position. Since, for the purposes of a failsafe design, the plunger is preferably drawn into the coil interior space counter to the action of a restoring spring, comparatively high magnetic forces are required in particular to hold the plunger static in the active position, and therefore the coil arrangement is supplied with a correspondingly high level of electrical power.

The pinion normally has a circumferential toothing with axially extending teeth. Complementary with respect thereto, the gearwheel of the internal combustion engine likewise has a circumferential toothing with axially running teeth. Upon a transfer of the pinion from the non-engagement position into the engagement position, the teeth of the pinion engage in toothed spaces of the gearwheel. However, in many situations, axially leading tooth flanks of the teeth of the pinion do not pass directly into the toothed spaces of the toothing of the gearwheel but strike against axial tooth flanks of the teeth of the gearwheel. In order that the teeth of the pinion nevertheless find the toothed spaces of the gearwheel and can engage therein, the electric motor of the starter may be activated so as to effect a rotation of the pinion as early as during the adjustment of the pinion from the non-engagement position into the engagement position. Said rotation for the threading-in of the pinion into the gearwheel is expediently performed with a considerably reduced torque and/or with a considerably reduced rotational speed in relation to the subsequent starting operation, when the pinion is fully engaged with the gearwheel.

For said two-stage starting operation, which may also be referred to as "soft-start", in the case of a starter of this type an electric series connection of the electric motor and of the solenoid drive is expediently proposed, and therefore, for the reduced driving of the electric motor, the voltage provided for energising the coil arrangement can be used in conjunction with the associated current. The solenoid drive then serves at the same time as a switch for connecting the electric motor to the actual motor current supply. In this respect, the solenoid drive at the same time forms an electromagnetic switch.

Owing to the above-described, comparatively high magnetic force with which the plunger is drawn into the coil interior space, the pinion may, by way of the axially leading tooth flanks thereof, collide with the opposite axial tooth flanks of the gearwheel with corresponding intensity, increasing the wear of the toothings of pinion and gearwheel. Furthermore, the toothings may bear against one another via the axial tooth flanks with a comparatively high force, as a result of which a correspondingly high level of friction has to be overcome in order to rotate the pinion relative to the gearwheel such that the toothing of the pinion can mesh with the toothing of the gearwheel. As a result, there is the risk of increased wear here too.

A starter of this type is known, for example, from U.S. Pat. No. 8,421,565 B2. To solve the above mentioned problem, in the case of the starter, said document proposes a complex construction of the coil arrangement within the solenoid drive, wherein a retraction coil for pulling the plunger into the coil interior space and a holding coil for holding the plunger that is being pulled into the coil interior space are arranged axially separately from one another. It is also proposed that the plunger be equipped, on the outer circumference thereof, with an encircling annular groove which, in the passive position, is situated radially opposite an edge region circumferentially surrounding a passage opening, through which the plunger passes axially, of an end side wall of a solenoid housing. In this way, in the passive position, there is a radial gap between plunger and edge region. As the plunger is retracted into the coil interior space, the circumferential groove moves into the coil interior space and thereby departs from the above mentioned edge region of the end side wall, such that said edge region is subsequently situated radially opposite a plunger longitudinal section axially adjoining the circumferential groove. As the plunger is retracted, therefore, a radial distance between said edge region and an outer side of the plunger is varied, specifically reduced, as a result of which the density of the magnetic field lines transmitted from said edge region to the plunger when the coil arrangement is switched on, is varied, specifically increased. However, the density of the magnetic field lines correlates with the acting magnetic forces. The circumferential groove formed on the plunger thus yields a reduction in the acting magnetic forces at the start of the retraction movement of the plunger when the pinion is to be transferred from the non-engagement position into the engagement position. Said known measures are, however, relatively cumbersome to realise. Furthermore, the attractive force that pulls the plunger into the coil interior space is reduced only to a comparatively small extent by the annular groove, since said annular groove ultimately merely effects a deflection of the field lines. Also, the annular groove is maintained and, even when the plunger has been retracted into the coil interior space, causes a deflection of the field lines in the plunger, thus reducing the attainable magnetic forces.

Another solenoid drive or electromagnetic switch for an auxiliary-rotation starter is known form U.S. Pat. No. 8,248,193 B2 and suggests a sleeve like bypass device extending from the plunger stop to the axial end of the coil arrangement through which the plunger extends into the coil interior space. In the passive position the plunger extends essentially into the bypass device.

DE 10 2009 052 938 A1 discloses another solution to this problem. In this document, the solenoid drive, which is referred to as an electromagnetic switch, is equipped with a ferromagnetic bypass device, which, when the coil arrangement is energized, diverts some of the magnetic field lines directly from the plunger into the plunger stop, at least in the passive position of the plunger, such that said field lines do not extend through an air gap formed axially between the plunger and the plunger stop. Since, however, the field lines extending through said air gap are crucial for the magnetic force which drives the plunger into the coil interior space, the force acting on the plunger may be reduced for the beginning of the adjustment movement. With increasing penetration depth of the plunger into the coil interior space, the diversion of the magnetic field lines by the bypass device is reduced, as a result of which the magnetic force driving the plunger increases. It has even been shown that, in the active position, the magnetic holding force which holds the plunger in the active position can be increased with the aid of such a bypass device. The same then holds true for the forces which act on the pinion and drive the pinion from the non-engagement position into the engagement position and optionally hold said pinion therein. In this known configuration a part of the magnetic flux is bypassing the axial gap between plunger and plunger stop by passing directly from the housing via the bypass device to the plunger stop. Therefore, the exact axial position of the bypass device relative to the housing and relative to the plunger stop is essential for the deviating effect. Accordingly, narrow production tolerances have to be used.

In the case of the known solenoid drive, the bypass device is formed by a ferromagnetic annular body which is dimensioned and arranged in the coil interior space in such a manner that said annular body extends as far as the second axial end of the coil arrangement and is supported there preferably on the housing and is in contact therewith.

By means of the bypass device the magnetic attraction force operating on the plunger can be reduced in order to provide a soft contact when the pinion engages the gearwheel. The known solenoid drives provide significantly reduced magnetic attraction force from the beginning of the plunger movement until the end section of the plunger movement. In this end section of the plunger movement the magnetic attraction force increase significantly. In particular the initial forces being effective at the beginning of the plunger movement are the smallest during the complete plunger movement. Consequently, the magnetic attracting forces are only increasing form the beginning to the end of the plunger movement.

It has been found that such solenoid drives performing the soft-start can be disadvantageous under cold ambient conditions. In cold ambient conditions lubricants show high viscosity. Moist in the air can condensate and freeze, thus ice can occur on sliding surfaces. These conditions lead to increased resistance for the movement of the plunger. The significantly reduced initial forces can be too small to overcome said increased resistance, thus the solenoid drive fails to move the pinion in place.

SUMMARY

The present invention is concerned with the problem of specifying, for a solenoid drive of the type mentioned in the introduction or for a starter equipped therewith or for an operating method, an improved or at least different embodiment which is characterized by an improved reliability especially in cold ambient conditions. At the same time, the intention is furthermore to ensure reduced wear of the pinion and/or of the gearwheel that interacts therewith. In particular, the intention is to specify an advantageous or alternative way of reducing the acting magnetic forces at the start of the adjustment of the pinion from the non-engagement position into the engagement position.

This problem is solved according to the invention by the features of the independent claims. The dependent claims relate to advantageous embodiments.

The invention is based on the general concept of dimensioning and arranging the bypass device in such a manner that said bypass device is spaced apart axially from both axial face side walls axially limiting a coil receiving chamber in which the coil arrangement is arranged. Therefore, the bypass device does not come into contact with the housing and the plunger stop for the deflection of the magnetic field lines. The invention makes use of the finding that for the purpose of deviating the magnetic field lines the bypass device does not need to come into contact with the housing at the face side wall which is in proximity of the plunger. In the invention a part of the magnetic flux is bypassing the axial gap between plunger and plunger stop by passing directly from the plunger via the bypass device to the plunger stop.

In particular, the dimensioning and arrangement of the bypass device are undertaken in such a manner that a plunger end side facing the central region of the plunger stop is positioned axially within the bypass device in the passive position. In other words, in the passive position an axial overlap is provided between the plunger and the bypass device. On the other hand, said plunger end side is adjusted axially beyond the bypass device in the direction of the central region in the active position. In particular, the plunger end side is then located axially between the plunger stop and the bypass device. Preferably, the bypass device and the coil arrangement are arranged in the coil receiving chamber. In a preferred embodiment said plunger end side and/or a stop end side of the central region extend/extends planar in a plane extending perpendicular to the axial direction of the plunger.

By means of this axial overlap in the passive position high initial forces can be achieved sufficient to overcome initial friction, mass inertia, resistance of lubricants especially in cold conditions. As soon as the plunger is moving this high initial forces, which represent a first local maximum, are steadily reduced by the effect of the bypass device to a local minimum. From said minimum the forces increase steadily and reach a second local maximum which preferably is higher than the first local maximum. In a preferred embodiment said local minimum can be a global minimum, i.e. the smallest value of the magnetic attracting force during the plunger movement from the passive position to the active position. According to another embodiment said second local maximum can be a global maximum, i.e. the highest value of the magnetic attracting force during the plunger movement from the passive position to the active position.

In case the coil arrangement is electrically energized for moving the plunger from the passive position into the active position a magnetic attracting force operates on the plunger generating a movement of the plunger from the passive position to the active position. In a conventional solenoid drive said magnetic attracting force only increases from the passive position. In other words, said magnetic attracting force has a minimum at the passive position.

According to a preferred embodiment of the present invention an axial position of the bypass device axially between the two face side walls of the coil receiving chamber, an axial height of the bypass device, and the axial overlap between the plunger and the bypass device are coordinated or adjusted in such a way, that said magnetic attracting force has a first local maximum at the passive position, then decreases from said first local maximum to a local minimum, and then increases from said local minimum to a second local maximum. By this specific arrangement a sufficient force is provided to start the movement of the plunger and the other moving parts of a starter in all operating conditions, especially cold and moist conditions. But in the main portion of the plunger movement, in which the collision of the pinion of the starter motor with the ring gear is expected, said magnetic attracting forces are significantly reduced in order to prevent pinion and gear ring wear.

Another improved embodiment can be achieved, when said local minimum is within a first half or within a first third of the movement of the plunger between the passive position and the active position, in particular between the first local maximum and the second local maximum. In other words, said local minimum is closer to the passive position than to the active position.

To achieve said decrease of the magnetic force at the beginning of the plunger movement, it is crucial to have a small overlap in the passive position between the plunger and the bypass device. This overlap is adjusted such that at the beginning of the plunger movement only a portion of the magnetic field lines between plunger and plunger stop can be deviated through the bypass device and the housing. Then, with an increasing overlap between plunger and bypass device more magnetic field lines can be deviated through the bypass device and the housing causing a loss of magnetic attracting force between plunger and plunger stop. At a specific overlap, this deviation effect has a maximum and thus the magnetic attracting force has said local minimum. With further increasing overlap the deviating effect decreases and the magnetic field lines tend to go directly from the plunger to the plunger stop and therefore increase correspondingly the magnetic attracting force.

According to an embodiment the axial overlap is less than 50%, preferably less than 40%, more preferably less than a third, and more preferably less than 30%, in particular less than 25% or preferably less than 20%, of an axial height of the bypass device. With this relative small axial overlap the deviation of the magnetic flux through the bypass device can increase significantly when the plunger moves further into the bypass device. Therefore, after providing a high initial force at the beginning of the movement the force driving the plunger is significantly reduced in order to achieve the soft-start operation.

It has been determined that surprisingly good results can be achieved, when the axial overlap is less than three times of a radial wall thickness of the bypass device, more preferably, when the axial overlap is less than 5 mm plus the half of a radial wall thickness of the bypass device.

According to a preferred embodiment the bypass device can be ring-shaped and can have in the circumferential direction a constant radial wall thickness and a constant axial height. With this feature manufacturing costs can be reduced.

The bypass device can be realized in different ways. Preferably, the bypass device can have at least one winding made from a ferromagnetic wire, or can be formed therefrom, or the bypass device can have a plurality of ferromagnetic bypass elements distributed in the circumferential direction, or the bypass device can have a ferromagnetic ring body extending in the circumferential direction continuously or with a single interruption. For example, the ring body can be formed by means of a metal strip which is bent annularly such that longitudinal ends of the metal strip abut against each other and define said interruption.

Another embodiment suggests that the bypass device is at a respective axial distance from the two face side walls which axial distance is at least 20% of an axial length of the coil receiving chamber. The axial length of the coil receiving chamber corresponds here to the axially measured distance between the two face side walls which axially limit the coil receiving chamber. Preferably, the bypass device is arranged closer to the second face side wall such that an axial distance between the bypass device and the first face side wall is bigger than an axial distance between the bypass device and the second face side wall. More preferably, the axial distance between the bypass device and the first face side wall is as big as or bigger than the sum of the axial height of the bypass device and the axial distance between the bypass device and the second face side wall. In an alternative embodiment the bypass device can be arranged closer to the first side wall such that an axial distance between the bypass device and the second side wall is bigger than an axial distance between the bypass device and the first side wall. In particular, the axial distance between the bypass device and the second face side wall is as big as or bigger than the sum of the axial height of the bypass device and the axial distance between the bypass device and the first face side wall. This positioning and/or dimensioning of the bypass device supports the increase of the magnetic force after a predetermined length of the movement of the plunger in order to provide the high magnetic forces needed for holding the plunger in the active position.

According to a preferred embodiment the central region of the plunger stop can have an axial distance from the bypass device. In other words, the central region does not extend axially into the bypass device. Preferably, said axial distance between the central region and the bypass device is bigger than the overlap. Alternatively or additionally, said axial distance between the central region and the bypass device is smaller than the axial height of the bypass device. Also this positioning and/or dimensioning of the central region supports the increase of the magnetic force after a predetermined length of the movement of the plunger, in particular when the plunger extends axially through the bypass device.

Easy manufacturing can be achieved, when the coil arrangement has a cylindrical coil carrier onto which the at least one coil is wound radially on the outside, and when the bypass device is in contact with said coil carrier and is arranged radially on the inside of the at least one coil. In this case, the bypass device is a part of the coil arrangement which can be pre-assembled and can be inserted to the solenoid drive as a whole unit.

Preferably, the bypass device can be inserted into an inner reception which is provided radially on the inside of the coil carrier such that an outer wall portion of the coil carrier is radially between the bypass device and the at least one coil. Alternatively, the bypass device can be inserted into an outer reception which is provided radially on the outside of the coil carrier such that an inner wall portion of the coil carrier is radially between the bypass device and the coil interior space. Alternatively, the bypass device can be integrated into the coil carrier such that on the one hand an outer wall portion of the coil carrier is radially between the bypass device and the at least one coil, while on the other hand an inner wall portion of the coil carrier is radially between the bypass device and the coil interior space.

Preferably, the plunger stop comprises the first face side wall coaxially surrounding the central region, wherein the second face side wall is provided at the housing coaxially surrounding the plunger. This simplifies the manufacture of the solenoid drive.

According to an advantageous development, the coil carrier can have an annular step with which said coil carrier is plugged axially onto the bypass device formed by the sleeve section. In this case, the bypass device can therefore the used as an assembly aid for the coil arrangement.

As mentioned above, the bypass device can have at least one winding made from a ferromagnetic wire, or can be formed therefrom. In particular, the bypass device can thereby be integrated particularly simply into the coil arrangement. For example, the winding of the bypass device can be wound onto the coil carrier, onto which the at least one coil of the coil arrangement is also wound. By this means, the coil arrangement with integrated bypass device can be produced particularly inexpensively.

As mentioned above, the bypass device can have a plurality of bypass elements which are distributed in the circumferential direction and are made from ferromagnetic material. By means of the use of a plurality of bypass elements distributed in the circumferential direction, instead of an encircling, undivided annular body which is closed in the circumferential direction, the influence of the bypass device on the field lines can be varied. In particular, particularly fine coordination can thereby be realised. The bypass elements can be arranged in an annular support of the bypass device, which simplifies the handling of the bypass device despite there being a plurality of separate bypass elements. It is also conceivable to arrange the individual bypass elements on the coil carrier, either radially on the inside in a corresponding receiving region or radially on the outside in the region of the at least one coil. The bypass elements can directly adjoin one another in the circumferential direction such that said bypass elements together again form a closed ring which is, however, divided or segmented. Alternatively, the individual bypass elements can also be arranged spaced apart from one another in the circumferential direction.

In an advantageous embodiment, the plunger can be guided in an axially adjustable manner radially on the inside of a cylindrical guide sleeve which is arranged coaxially on the inside of the coil arrangement and which extends from the first axial end through the coil interior space and beyond the second axial end into a guide region of the housing, through which guide region the plunger passes With the aid of a guide sleeve of this type, precise axial guidance for the plunger can be realised, as a result of which the solenoid drive has increased functional reliability.

The solenoid drive can be equipped with an actuating rod which is connected in terms of drive to the plunger and which is guided axially through the plunger stop. On a side of the plunger stop facing away from the coil interior space, said actuating rod bears an electrically conductive contact plate, with the aid of which, in the active position of the plunger, two electric contacts are connected in an electrically conductive manner to each other for example in order to connect the electric motor of the starter to the main current supply thereof. The contact plate and the contacts therefore form a switch within the solenoid drive, and therefore the entire solenoid drive may also be referred to as an electromagnetic switch.

A starter according to the invention for an internal combustion engine comprises a support, an electric motor which is arranged on the support and serves for driving a pinion in rotation, and a solenoid drive of the type described above which is arranged on the support and serves for the axial adjustment of the pinion between an engagement position, which is provided for the drive of a gearwheel of the internal combustion engine, and a non-engagement position, which is offset axially with respect to the engagement position.

The operation method according to the invention provided a specific progression of the magnetic attraction forces acting on the plunger during its movement from the passive position to the active position. According to this method the magnetic attracting force operating on the plunger start in the passive position with a first local maximum and are steadily reduced during a first phase of the movement to a global minimum. Then these magnetic attracting forces operating on the plunger are steadily increased during a second phase of the movement from said minimum to a second local maximum. Said second local maximum may be at the active position. Preferably, the coil arrangement comprises an attracting or pulling coil and a holding coil. For the movement of the plunger from the passive position to the active position usually both coils are electrically energized, i.e. excited. In the last third of the plunger movement the attracting or pulling coil can be deactivated. Then only the holding coil is electrically energized and thus excited and generates the magnetic attracting force for pulling the plunger through the last distance into the active position. When the attracting coil is deactivated a significant drop occurs in the magnetic attracting force. Usually the attracting coil is stronger or more powerful than the hodling coil. Said drop defines another or second local minimum from which the magnetic attracting force increases to a third local maximum at the active position. In such a case, the second local minimum can have lower magnetic attracting forces than the first local minimum. Said second local minimum accordingly defines a global minimum in this case. Also the third local maximum usually is smaller than the second local maximum and preferably higher than the first local maximum. Accordingly, said second local maximum preferably defines a global maximum.

It is important to understand, that during the plunger movement the electrical power used to electrically energize the coil arrangement is constant. Preferably, a constant electrical voltage is provided. The electric current drawn from the coil arrangement may depend from the demand of the coil arrangement and can vary according to the impedance of the coil arrangement and/or according to the actual relative position between plunger and plunger stop.

Further important features and advantages of the invention will emerge from the dependent claims, from the drawings and from the associated description of the figures with reference to the drawings.

It is self-evident that the features mentioned above and the features yet to be explained below can be used not only in the respectively stated combination, but also in other combinations or individually, without departing from the scope of the present invention.

Preferred exemplary embodiments of the invention are illustrated in the drawings and will be explained in more detail in the description below, wherein the same reference signs relate to identical or similar or functionally identical components.

BRIEF DESCRIPTION OF THE DRAWINGS

In the drawings, in each case schematically.

DETAILED DESCRIPTION

Figure 1:
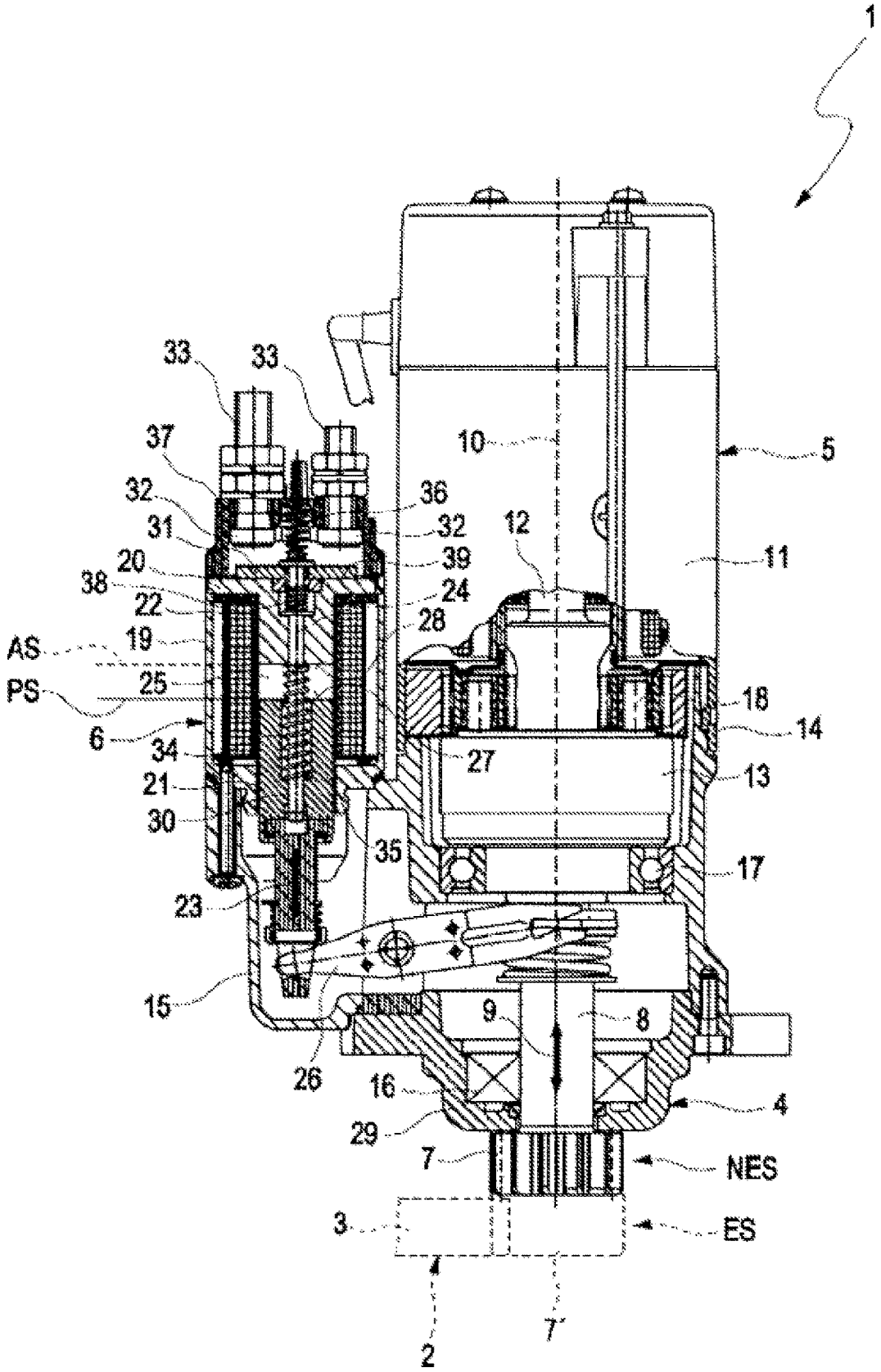
FIG. 1 shows a side view with a partial longitudinal section of a starter with a conventional solenoid drive.

According to FIG. 1, a starter 1 which is provided for starting an internal combustion engine 2, of which only a portion of a gearwheel 3 is indicated in FIG. 1 by dashed lines, comprises a support 4, an electric motor 5 and a solenoid drive 6, which serves at the same time as a switch for actuating the electric motor 5. The gearwheel 3 is incorporated in a suitable manner into a drive train (not shown specifically here) of the internal combustion engine 2 such that said gearwheel is connected in terms of drive to a crankshaft of the internal combustion engine 2 if the internal combustion engine 2 is, as is preferred, a piston engine with a crankshaft. For example, the gearwheel 3 may be formed on a flywheel of the drive train.

The support 4 is designed for fastening the starter 1 to the internal combustion engine 2 or to a peripheral of the internal combustion engine 2 which may be located, for example, in a vehicle which is equipped with the internal combustion engine 2.

The electric motor 5 is arranged on the support 4 and serves for driving a pinion 7 in rotation. The pinion 7 serves for driving the gearwheel 3 when the internal combustion engine 2 is intended to be started with the aid of the starter 1. For this purpose, the pinion 7, together with a drive shaft 8 on which the pinion 7 is arranged for conjoint rotation therewith, is adjustable bilinearly in an axial direction 9, which is defined by an axis of rotation 10 of the drive shaft 8 or of the electric motor 5, between a non-engagement position NES, which is shown in FIG. 1 by solid lines, and an engagement position ES, which is indicated in FIG. 1 by dashed lines. In said engagement position ES, the pinion is assigned the reference sign 7'. In the engagement position ES, the pinion 7' serves for driving the gearwheel 3 and thus meshes with the latter such that a rotation of the pinion 7' forces a rotation of the gearwheel 3. In the non-engagement position NES, the pinion 7 is axially offset with respect to the engagement position ES, specifically to such an extent that said pinion does not mesh with the gearwheel 3. In this respect, the pinion 7 is then arranged axially spaced apart from the gearwheel 3.

The electric motor 5 furthermore has, in the conventional manner, an external stator 11 and an internal rotor 12, wherein the rotor 12 is connected in terms of drive to the drive shaft 8 via a transmission device 13. The transmission device 13 may have a clutch, in particular a one-way friction clutch. The transmission device 13 may additionally or alternatively have a gearing 18, for example a planetary gearing. The stator 11 is accommodated in a stator housing 14 which is fastened to the support 4. In the situation shown, the support 4 has a base housing 29, which serves for the fastening of the starter 1 to said peripheral, and an intermediate housing 15, which is fastened to the base housing 29. In the example shown, the stator housing 14 is now fastened to said intermediate housing 15.

The drive shaft 8 is mounted by way of a main bearing 16 on the support 4 or on the base housing 29 thereof. A further bearing 17 is provided in the intermediate housing 15, for the purpose of mounting the drive shaft 8.

The solenoid drive 6 has a solenoid housing 19 which is referred to below in short as housing 19 and which is fastened to the support 4, specifically to the intermediate housing 15 thereof. The solenoid drive 6 serves for the axial adjustment of the pinion 7. For this purpose, the solenoid drive 6 has a plunger stop 20 which is static with respect to the support 4, a plunger 21 which is axially adjustable relative to the plunger stop 20, and a cylindrical coil arrangement 22. An axial direction 23 of the axial adjustability of the plunger 21 is defined by a longitudinal central axis 24 of the solenoid drive 6. The solenoid drive 6 is expediently arranged on the support 4 so as to be parallel and adjacent to the electric motor 5, such that the longitudinal central axis 24 extends parallel to the axis of rotation 10.

The coil arrangement 22 is arranged on the plunger stop 20 and surrounds a cylindrical coil interior space 25 in a circumferential direction, which is based on the longitudinal central axis 24. The plunger 21 is coupled by way of a deflecting lever 26 to the drive shaft 8 in such a manner that, for the adjustment of the pinion 7 from the non-engagement position NES into the engagement position ES, the plunger 21 is retracted into the coil interior space 25. Accordingly, the coil arrangement 22 is in the form of a retraction coil 40 which, when energised, pulls the plunger 21 into the coil interior space 25. The deflecting lever 26 here effects a reversal of the movement direction, such that the retraction of the plunger 21 toward the top in FIG. 1 effects a deployment of the pinion 7 toward the bottom in FIG. 1. The plunger 21 is therefore adjustable with respect to the plunger stop 20 between an extended passive position PS and a retracted active position AS. In FIG. 1, the axial position of a plunger end side 27 facing the plunger stop 20 is indicated by solid lines for the passive position PS while the axial position of the plunger end side 27 is indicated by dashed lines for the active position AS. In the active position AS, the plunger end side 27 preferably comes axially to bear against a stop end side 28 of the plunger stop 20, which stop end side 28 faces the plunger 21 and therefore forms an axial end stop for the plunger 21.

In addition, the plunger 21 is coupled to an actuating rod 30 which, for this purpose, extends at least partially through the plunger 21. The actuating rod 30 serves for the axial adjustment of a plate-like contact element 31 which, for its part, serves for the electrical connection of two electric contacts 32. The electric motor 5 is connected to a main current supply 33 via said electric contacts 32. In other words, as soon as the contact element 31 electrically connects the two electric contacts 32 to each other, the electric motor 5 can be supplied with a rated electrical power via the main current supply 33 so that the electric motor 5 can output a rated torque at the pinion 7. In order to realise what is referred to as a "soft-start operation", provision may be made to connect the electric motor 5 in series with the solenoid drive 6 or with the coil arrangement 22 thereof. The electric motor 5 can therefore be initially supplied with a considerably lower electrical power in order to drive the pinion 7 with a considerably lower torque and/or at a considerably lower rotational speed for as long as said pinion has not yet reached the engagement position ES thereof.

The actuating rod 30 is guided coaxially through the plunger stop 20. Accordingly, the plunger stop 20 is ultimately located axially between the plunger 21 and the contact element 31. The plunger 21 is assigned at least one restoring spring 34 which, in the example, loops coaxially around the actuating rod 30. The restoring spring 34 is supported here on one side on the plunger 21 and on the other side on the plunger stop 20. The restoring spring 34 protrudes here in a cavity 35 formed on the plunger 21.

The actuating rod 30 is also assigned a restoring spring 36 which is supported on one side on the actuating rod 30 and on the other side on a contact housing 37, on which the electric contacts 32 are located. Furthermore, a pre-tensioning spring 38 can be provided which drives the contact element 31 in the direction of the contacts 32. Said pre-tensioning spring 38 is supported here on the actuating rod 30. An axial distance between the contact element 31 and the contacts 32 is discernibly smaller than the entire adjustment travel of the plunger 21 between the passive position PS and the active position AS. The contact element 31 therefore comes into contact with the contacts 32 shortly before reaching the active position AS. On reaching the active position AS, the pre-tensioning spring 38 then brings about a pre-tensioned bearing of the contact element 31 against the contacts 32. By means of the capacitive effect of coils/windings of the electric motor 5, the rated torque builds up with a time delay. The coordination is expediently undertaken here in such a manner that the rated torque is present approximately synchronously with the reaching of the active position AS, i.e. also synchronously with the reaching of the engagement position ES.

Furthermore, it can be seen that, in the passive position PS, the contact element 31 bears axially against a rear side 39 of the plunger stop 20, which rear side faces away from the plunger 21.

Since the solenoid drive 6 therefore also serves for the connection of the main current supply 33 of the electric motor 5, said solenoid drive may also be referred to as an electromagnetic switch.

According to FIGS. 2 to 5, the solenoid drive 6 comprises the housing 19 produced from a ferromagnetic material, the coil arrangement 22, the ferromagnetic plunger stop 20 and the ferromagnetic plunger 21. In the examples shown here, the coil arrangement 22 in each case comprises two coils, specifically a retraction coil 40 for pulling the plunger 21 into the interior of the coil arrangement 22 counter to the plunger stop 20, and a holding coil 41 for holding the plunger 21 in the active position AS. The coil arrangement 22 is arranged in a coil receiving chamber 64 of the housing 19 and coaxially surrounds the coil interior space 25. The col receiving chamber 64 is axially limited by a first face side wall 65 and a second face side wall 66 axially opposing the first face side wall 65.

The plunger stop 20 is arranged at a first axial end 42 of the coil arrangement 22 in the housing 19. The plunger stop 20 has a central region 43 which projects axially into the coil interior space 25 and has the above mentioned stop end side 28 which can serve as an axial stop for the plunger 21. The plunger stop 20 is provided with the first face side wall 65 which is ring shaped and coaxially encircling the central region 43. The second face side wall 66 is provided at the housing 19. In the depicted examples, the coil arrangement 22 axially abuts with its first axial end 42 to the first face side wall 65.

The plunger 21 projects axially into the coil interior space 25 at a second axial end 44 of the coil arrangement 22, which second axial end 44 is opposite the central region 43. In the depicted examples, this second axial end 44 is axially spaced apart from the second face side wall 66. Thus an axial gap 67 is provided axially between the second axial end 44 and the second face side wall 66. In this axial gap 67 a sealing member 49 is arranged and elastically deformed in order to press the coil arrangement 22 axially against the first face side wall 65.

Furthermore, the plunger 21, as explained, is arranged so as to be adjustable axially bi-directionally relative to the housing 19 between the active position AS which is proximal with respect to the central region 43 and the passive position PS which is distal with respect to the central region 43. In the passive position PS an axial air gap 63 is provided within the coil interior space 25 axially between the plunger 21 or the plunger end side 27, respectively, and the plunger stop 20 or the stop end side 28, respectively. This axial air gap 63 reduces when the plunger 21 moves from the passive position PS to the active position AS. As explained, in the active position AS, the plunger 21 can be in contact by means of the plunger end side 27 thereof with the stop end side 28 which is located on the central region 43 in the coil interior space 25. In this case the axial air gap 63 is eliminated in the active position AS.

In addition, the solenoid drive 6 shown here is equipped with a ferromagnetic bypass device 45. The latter is arranged within the coil receiving chamber 64, coaxially with respect to the coil arrangement 22 and radially within the respective coil 40, 41 of the coil arrangement 22. In a starting region of the adjustment travel of the plunger 21, which starting region has the passive position PS, the bypass device 45 brings about a deflection of magnetic field lines in such a manner that the deflected magnetic field lines are not guided within the coil interior space 25 through the axial air gap 63 prevailing there between plunger 21 and plunger stop 20, but rather pass from the plunger 21 via the bypass device 45 directly to the plunger stop 20. This results in a reduction in the magnetic forces which drive the plunger 21 in the coil interior space 25 in the direction of the plunger stop 20. With increasing penetration depth of the plunger 21 into the coil arrangement 22, said deflecting influence of the deflecting device 45 decreases. In particular, the field lines run substantially directly within the reduced air gap 63 from the plunger 21 to the plunger stop 20 in an end region of the adjustment travel of the plunger 21, which end region contains the active position AS.

In the embodiments of FIGS. 2 to 5 the bypass device 45 is arranged and dimensioned in such a manner that said bypass device 45 is spaced apart axially from both face side walls 65, 66 of the coil receiving chamber 64 and also from both axial ends 42, 44 of the coil arrangement 22. According to FIG. 2, the bypass device 45 can be at a respective axial distance 46, 47 from both face side walls 65, 66, which axial distance is at least 20% of an axial length 48 of the coil receiving chamber 64. The axial length 48 of the coil receiving chamber 64 is discernibly defined by the axial distance between the two face side walls 65, 66. In the other embodiments shown in FIGS. 3 to 5 the position and dimension of the bypass device 45 are approximately the same as in FIG. 2.

In the examples of FIGS. 2 to 5 the bypass device 45 is formed in each case by a single cylindrical and preferably annular body. By contrast, in the case of another embodiment (not shown) the bypass device 45 can be formed by a winding made from a ferromagnetic wire. In the case of another embodiment (also not shown) the bypass device 45 can be formed with the aid of a plurality of ferromagnetic bypass elements which are arranged distributed in the circumferential direction. The bypass elements can be adjacent to one another in the circumferential direction or preferably arranged spaced apart from one another.

In all of the embodiments shown here, the coil arrangement 22 has a cylindrical coil carrier 51 onto which the two coils 40, 41 are wound radially on the outside. The holding coil 41 is expediently wound here radially on the outside of the retraction coil 40 and extends in particular over the entire axial length of the retraction coil 40. The coil carrier 51 is expediently composed of a non-magnetic material. In particular, the coil carrier 51 has a tubular casing 50 which, at the axial ends thereof, has two annular end discs which protrude outward from the casing in the manner of collars and define the axial ends 42, 44 of the coil arrangement 22. The coils 40, 41 are arranged radially on the outside of the casing 50 and axially between the end discs, i.e. axial ends 42, 44.

Figure 2:
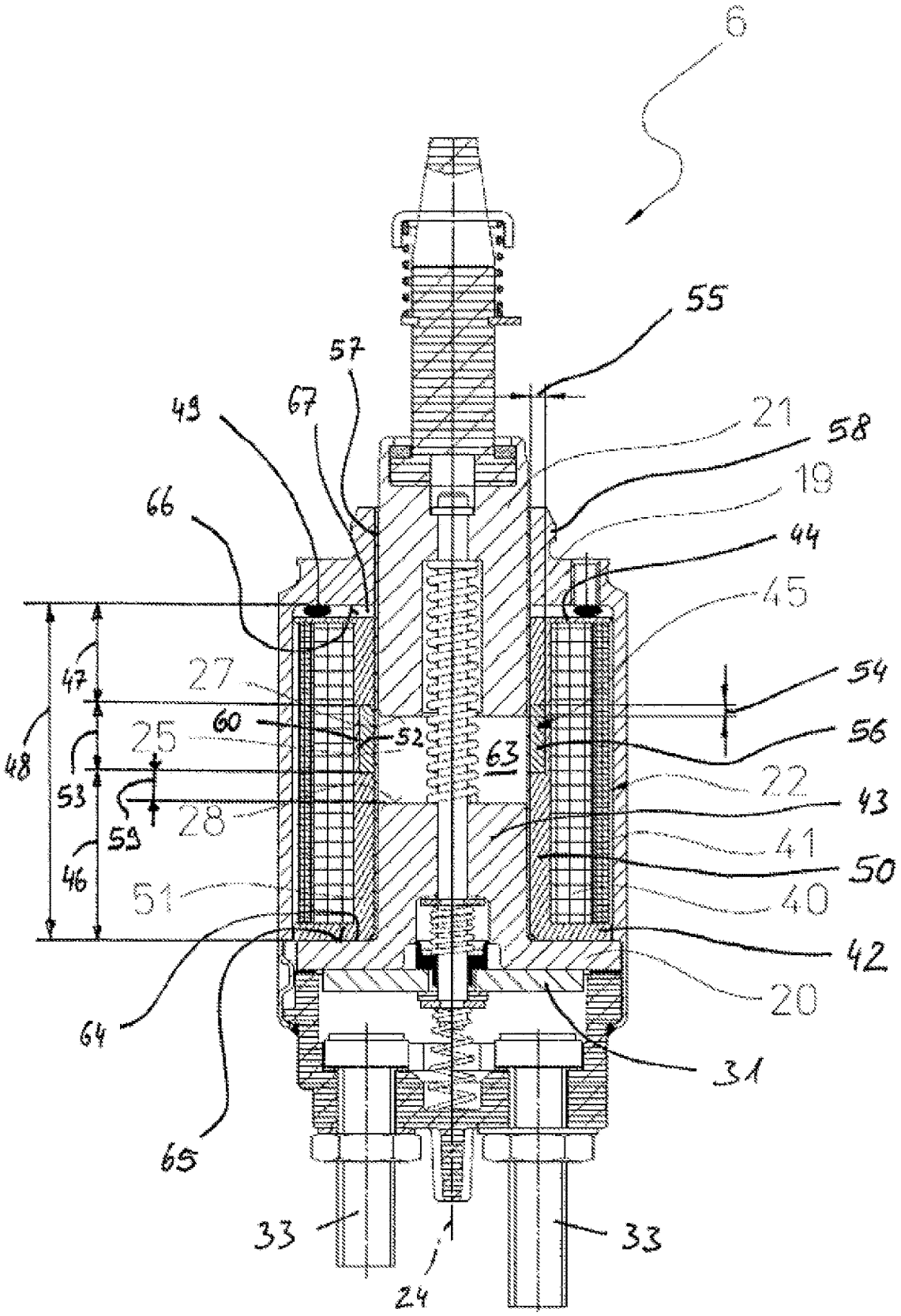
FIG. 2 to 5 show side views with a partial longitudinal section of a solenoid drive according to the invention of different embodiments in the region of a bypass device.

The bypass device 45 can now be arranged radially on the inside of the coil carrier 51, which is the case in the example of FIG. 2. In particular, for this purpose, an inner reception 52 which forms a depression on the radial inner side of the coil carrier 51 can be formed radially on the inside of the coil carrier 51. The bypass device 45 is inserted in said recessed inner reception 52. In the example of FIG. 2, the reception 52 extends axially only over the axial height 53 of the bypass device 45. For example, the coil carrier 51 which is produced from a plastic can be sprayed or injection moulded onto the outside of the bypass device 45.

In the examples of FIGS. 2 to 5, the bypass device 45 is integrated in the coil arrangement 22.

According to the examples of FIGS. 2 to 6, the solenoid drive 6 is expediently provided with a cylindrical guide sleeve 57 which is arranged coaxially on the inside of the coil arrangement 22 and which extends from the first axial end 42 through the coil interior space 25 and beyond the second axial end 44 into a guide region 58 of the housing 19. The plunger 21 passes through said guide region 58. The plunger 21 is guided in an axially adjustable manner radially on the inside of said guide sleeve 57. Said guide sleeve 57 is expediently produced from a non-magnetic material. For example, a low-friction plastic is used.

In all embodiments according to FIGS. 2 to 5 the dimensioning and arrangement of the bypass device 45 are undertaken in such a manner that the plunger end side 27 facing the central region 43 of the plunger stop 20 is positioned axially within the bypass device 45 in the passive position PS. In other words, in the passive position PS an axial overlap 54 is provided between the plunger 21 and the bypass device 45. On the other hand, said plunger end side 27 is adjusted axially beyond the bypass device 45 in the direction of the central region 43 in the active position AS. In particular, the plunger end side 27 is then located axially between the plunger stop 20 and the bypass device 45. Preferably, the bypass device 45 and the coil arrangement 22 are arranged in the coil receiving chamber 64. In a preferred embodiment said plunger end side 27 and the stop end side 28 of the central region 43 extend planar each in a plane extending perpendicular to the axial direction 23 of the plunger 21.

By means of this axial overlap 54 in the passive position PS high initial forces can be achieved sufficient to overcome initial friction, mass inertia, resistance of lubricants especially in cold conditions. According to the presented embodiments the axial overlap 54 is obviously less than 50% and in particular less than 25% of the axial height 53 of the bypass device 45. Said overlap 54 can be less than 40%, preferably less than 33.33%, more preferably less than 30%. Also an overlap 54 less than 20% can be of advantage. It has been determined that surprisingly good results can be achieved, when the axial overlap 54 is less than three times of a radial wall thickness 55 of the bypass device 45, more preferably, when the axial overlap 54 is less than 5 mm plus the half of the radial wall thickness 55 of the bypass device 45.

Preferably, the bypass device 45 is ring-shaped and has in the circumferential direction a constant radial wall thickness 55 and a constant axial height 53. To this end, the bypass device 45 can have a ferromagnetic ring body 56 extending in the circumferential direction continuously or with a single interruption. For example, the ring body 56 can be formed by means of a metal strip which is bent annularly such that longitudinal ends of the metal strip abut against each other and define said interruption.

As discussed above the bypass device 45 is at a respective axial distance 46, 47 from the two face side walls 65, 66. According to the embodiments depicted in the examples of the Figures, the bypass device 45 can be arranged closer to the second face side wall 66 such that the axial distance 46 between the bypass device 45 and the first face side wall 65 is bigger than the axial distance 47 between the bypass device 45 and the second face side wall 66. More preferably, the axial distance 46 between the bypass device 45 and the first face side wall 65 can be as big as or even bigger than the sum of the axial height 53 of the bypass device 45 and the axial distance 47 between the bypass device 45 and the second face side wall 66. In other words, the bypass device 45 can be arranged completely within the axial half of the coil arrangement 22 which is facing the second face end wall 66.

According to a preferred embodiment the stop end side 28 of the central region 43 of the plunger stop 20 has an axial distance 59 from the bypass device 45. In other words, the central region 43 does not extend axially into the bypass device 45. Preferably, said axial distance 59 between the stop end side 28 and the bypass device 45 is bigger than the overlap 54. Alternatively or additionally, said axial distance 59 between the stop end side 28 and the bypass device 45 is smaller than the axial height 53 of the bypass device 45.

As mentioned before, the coil arrangement 22 has a cylindrical coil carrier 51 onto which the respective coils 40, 41 are wound radially on the outside. The bypass device 45 is in contact with said coil carrier 51 and is arranged radially on the inside of the coils 40, 41. In this case, the bypass device 45 is a part of the coil arrangement 22 which can be pre-assembled and can be inserted into the solenoid drive 6 as a whole unit or assembly.

In FIG. 2 the bypass device 45 can be inserted into an inner reception 52 which is provided radially on the inside of the coil carrier 51 such that an outer wall portion 60 of the coil carrier 51 is radially between the bypass device 45 and the coils 40, 41.

Figure 4:
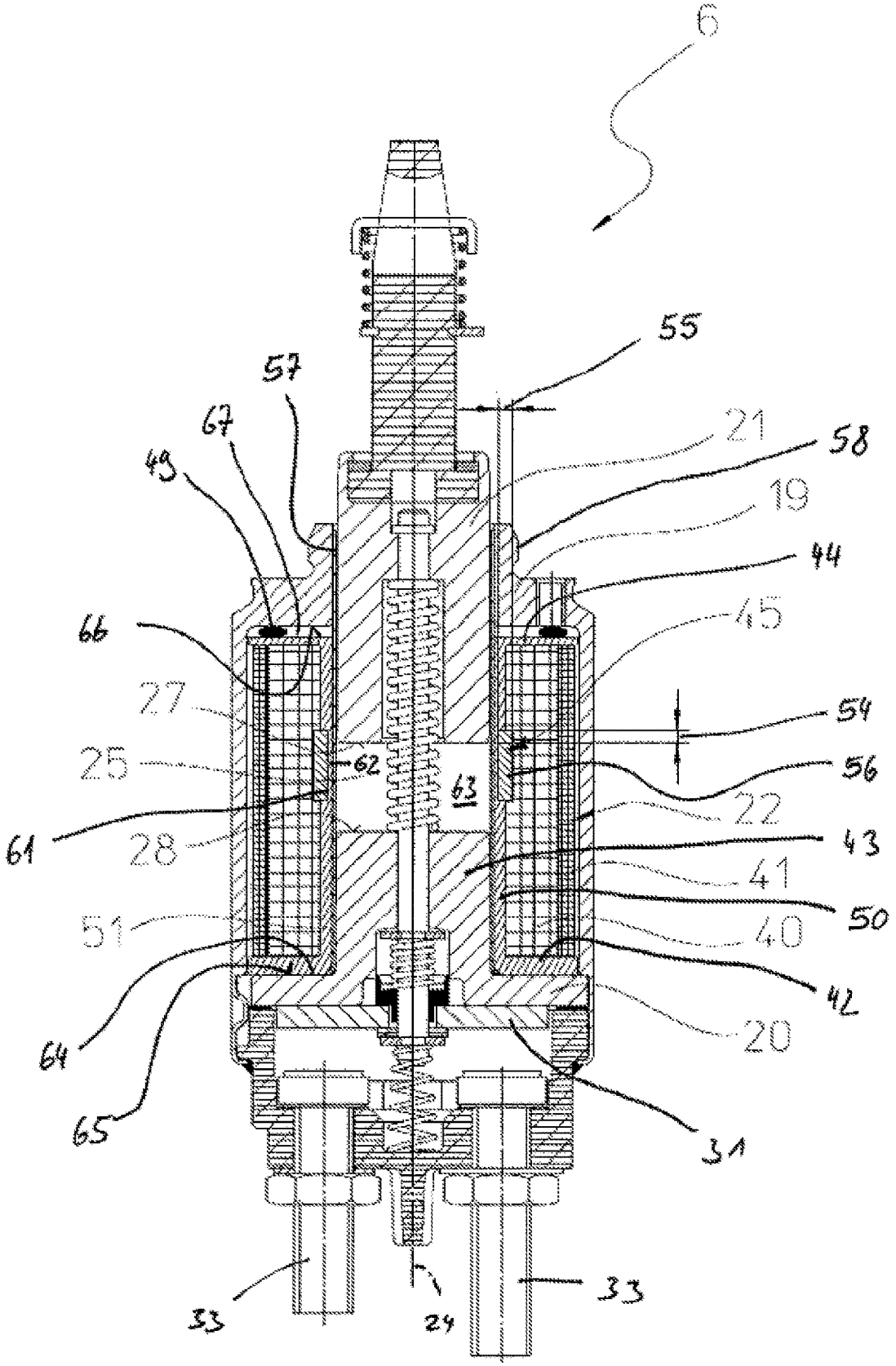
Figure 5:
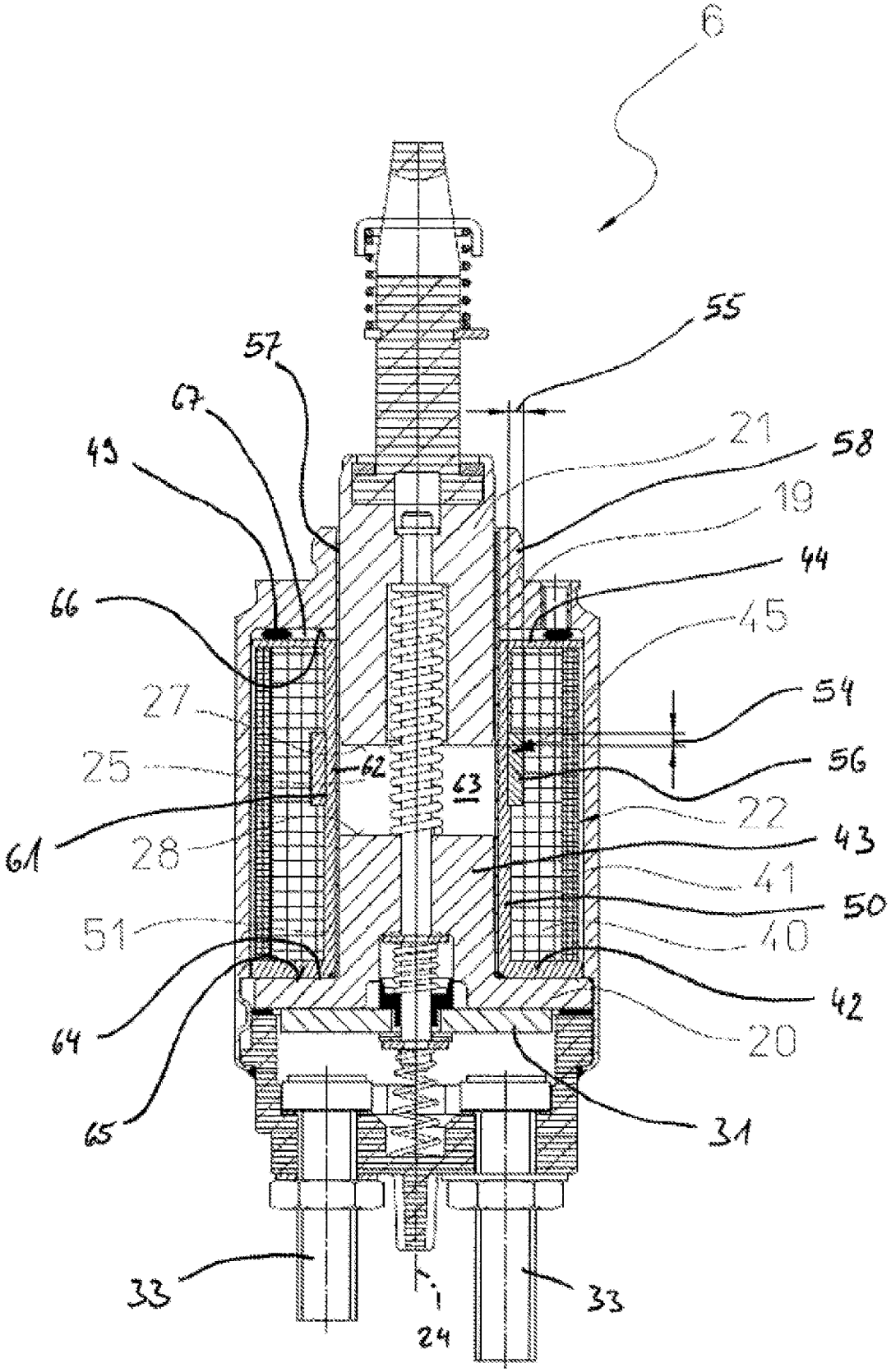

In FIGS. 4 and 5 the bypass device 45 is inserted into an outer reception 61 which is provided radially on the outside of the coil carrier 51 such that an inner wall portion 62 of the coil carrier 51 is radially between the bypass device 45 and the coil interior space 25.

Figure 3:
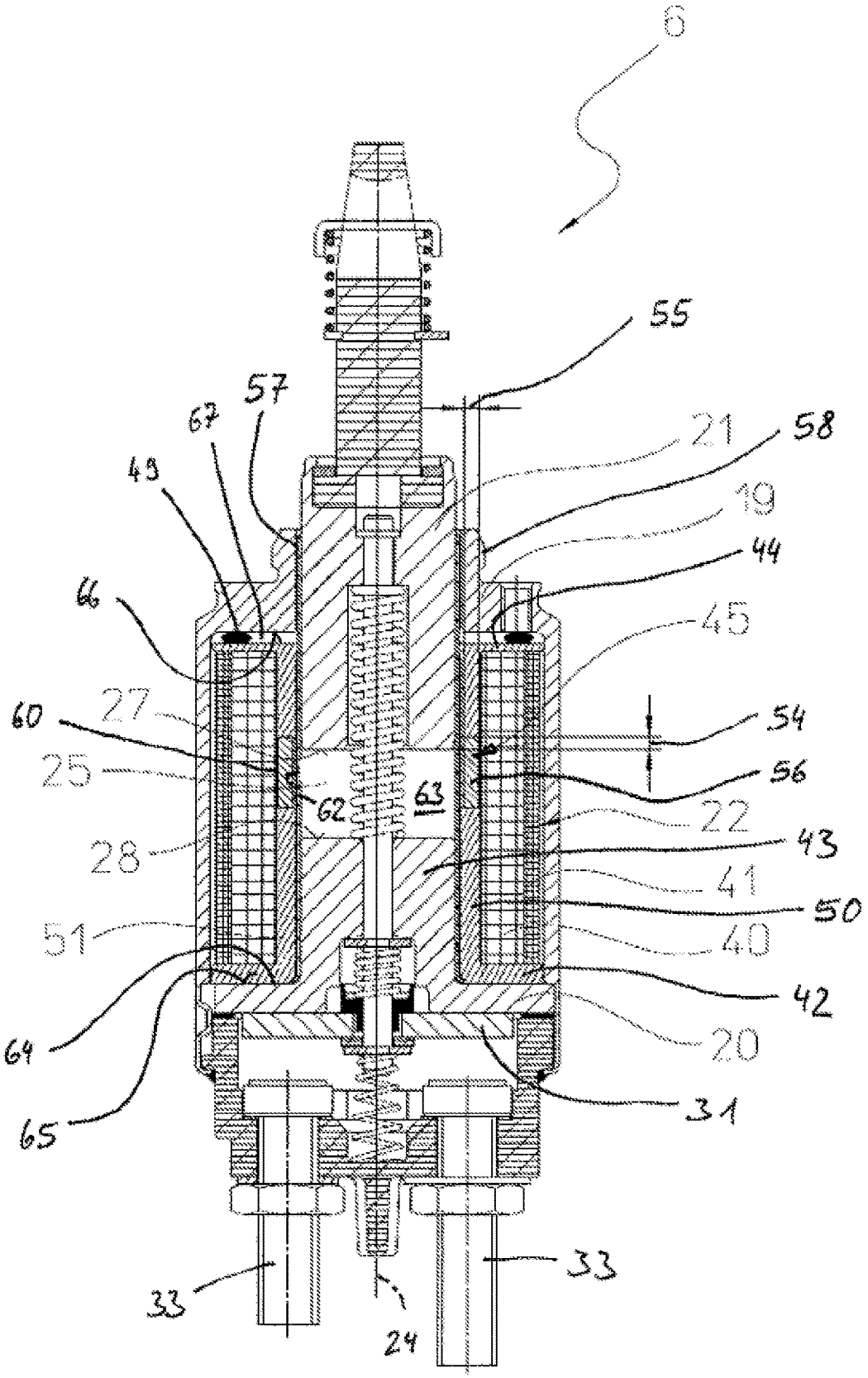

In FIG. 3 the bypass device 45 is integrated into the coil carrier 51 such that on the one hand an outer wall portion 60 of the coil carrier 51 is radially between the bypass device 45 and the coils 40, 41, while on the other hand an inner wall portion 62 of the coil carrier 51 is radially between the bypass device 45 and the coil interior space 25.

Figure 6:
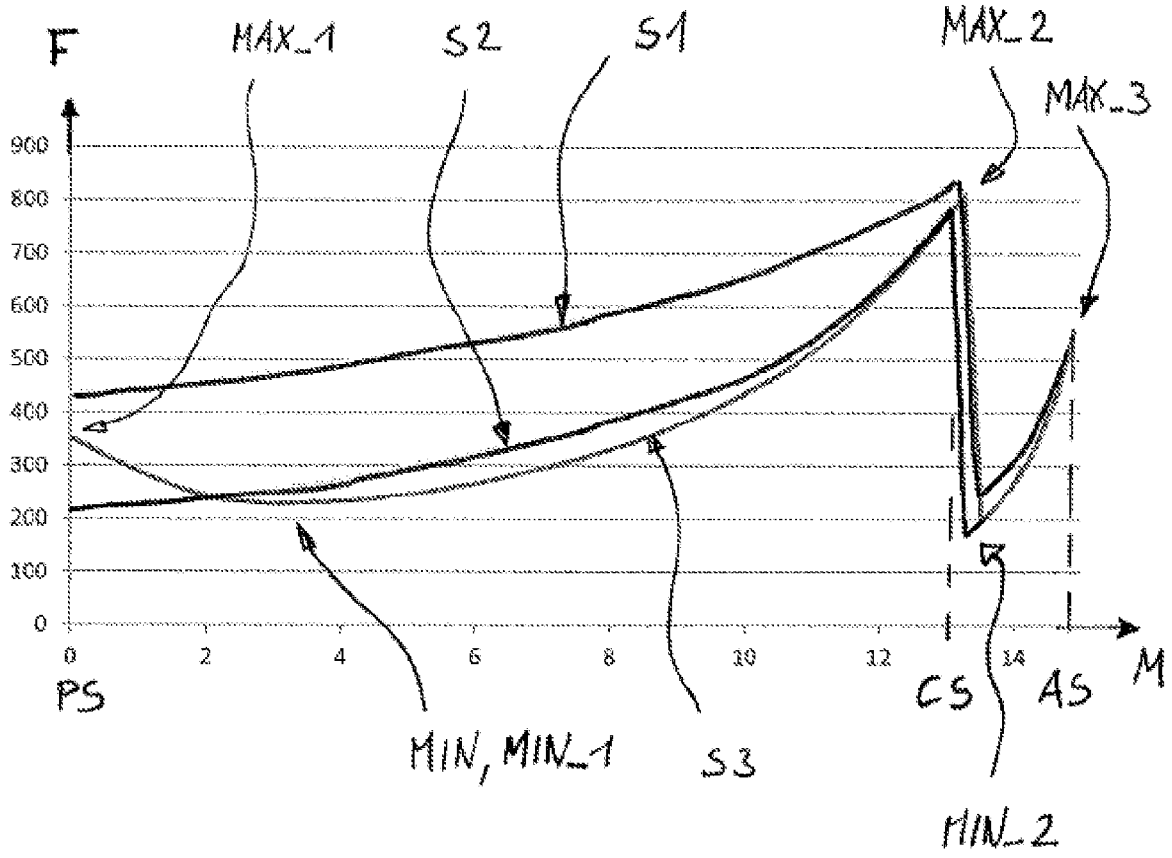
FIG. 6 shows a diagram in which a magnetic force is depicted depending on a movement of a plunger.

In case the coil arrangement 22 is electrically energized for moving the plunger 21 from the passive position PS into the active position AS a magnetic attracting force F operates on the plunger 21 generating a movement M of the plunger 21 from the passive position PS to the active position AS. FIG. 6 shows a diagram with the magnetic attracting force F on the ordinate and the plunger movement M on the abscissa. The values on the ordinate may be e.g. Newtons, the values on the abscissa may be e.g. millimetres. The diagram of FIG. 6 contains three curves or curve progressions, namely a first curve S1, a second curve S2, and a third curve S3.

In the examples depicted in FIG. 6 the electrical energizing of the coil arrangement 22 includes activating an attracting coil and a holding coil simultaneously. The coil arrangement 22 is provided with a constant electrical power. At a position CS, which can be in the last quarter of the plunger movement M, the attracting coil is deactivated. Therefore, a drop of the magnetic force F occurs at this switching position CS. From this switching position on only the holding coil is active for generating the magnetic force F.

The first curve S1 shows the progression of the magnetic attracting force F depending on the plunger movement M in a conventional solenoid drive having no bypass device. The magnetic attracting force F starts in the passive position PS at a relatively high level of magnetic force F. During the plunger movement M the magnetic force F only increases from the passive position PS to the switching position CS. In other words, said magnetic attracting force F has a minimum at the passive position PS.

The second curve S2 shows the effect of the bypass device 45 in a conventional solenoid drive, in which the bypass-device 45 is in contact with one of the two face side walls 65, 66 and in which the overlap 54 is more than 50% of an axial height 53 of the bypass device 54. Such a conventional solenoid drive is known for example from EP 3 184 804 A1. In such a conventional solenoid drive the second curve S2 of the magnetic attracting force F starts in the passive position PS at a reduced level of magnetic force F compared to the aforementioned first curve S1 of a solenoid drive having no bypass device. But also in this case, the magnetic force F only increases during the plunger movement M from the passive position PS to the switching position CS. In other words, said magnetic attracting force F also has a minimum at the passive position PS.

According to solenoid drive 6 presented in this description an axial position of the bypass device 54 axially between the two face side walls 65, 66 of the coil receiving chamber 64, the axial height 53 of the bypass device 45, and the axial overlap 54 between the plunger 21 and the bypass device 45 are coordinated or adjusted in such a way, that said magnetic attracting force F has the third curve S3. In this third curve S3 the progression of the magnetic force F has a first local maximum MAX_1 at the passive position PS, then decreases from said first local maximum MAX_1 to a local minimum MIN, and then increases from said local minimum MIN to a second local maximum MAX_2. The second local maximum MAX_2 is in this case at the switching position CS. Due to the drop of the magnetic force F at the switching position CS another local minimum occurs, which can be named second local minimum MIN_2. Consequently, the aforementioned local minimum MIN can also be named first local minimum MIN_1. Furthermore, the respective third curve S3 shows a third local maximum MAX_3 at the active position AS.

By this specific arrangement a sufficient force F is provided to start the movement M of the plunger 21 and the other moving parts of a starter 1 in all operating conditions, especially cold and moist conditions. But in the main portion of the plunger movement M, in which the collision of the pinion 7 of the starter 1 with the ring gear or gearwheel 3 is expected, said magnetic attracting force F is significantly reduced in order to prevent wear of said pinion 7 and said gearwheel 3.

Another improved embodiment can be achieved, when said local minimum MIN or MIN_1 is within a first half or within a first third of the movement M of the plunger 21 between the passive position PS and the active position AS, in particular between the first local maximum MAX_1 and the second local maximum MAX_2. In other words, said local minimum MIN or MIN_1 is closer to the passive position PS than to the active position AS.

To achieve said decrease of the magnetic force F at the beginning of the plunger movement M, it is crucial to have a small overlap 54 in the passive position PS between the plunger 21 and the bypass device 45. This overlap 54 is adjusted such that at the beginning of the plunger movement M only a portion of magnetic field lines between plunger 21 and plunger stop 20 can be deviated through the bypass device 45 and the housing 19. Then, with an increasing overlap 54 between plunger 21 and bypass device 45 more magnetic field lines can be deviated through the bypass device 45 and the housing 19 causing a loss of magnetic attracting force F between plunger 21 and plunger stop 20. At a specific overlap 54, this deviation effect has a maximum and thus the magnetic attracting force F has said local minimum MIN. With further increasing overlap 54 the deviating effect decreases and the magnetic field lines tend to go directly from the plunger 21 to the plunger stop 20 and therefore increase correspondingly the magnetic attracting force F.

As mentioned above the axial overlap is less than 50%, preferably less than 40%, more preferably less than a third, and more preferably less than 30%, in particular less than 25% or preferably less than 20%, of the axial height 53 of the bypass device 45. In the depicted examples the overlap 54 in the passive position PS is about 20% of the axial height 53 of the bypass device 45.

In the preferred example of FIG. 6, the third local maximum MAX_3 is higher than the first local maximum MAX_1 and lower than the second local maximum MAX_2. The second local maximum MAX_2 is higher than the first local maximum MAX_1 and higher than the third local maximum MAX_3. Consequently, the second local maximum MAX_2 defines a global maximum.

In the case depicted in FIG. 6 the first local minimum MIN_1 is higher than the second local minimum MIN_2. Therefore, the second local minimum MIN_2 defines a global minimum in this case. In another embodiment, the first local minimum MIN_1 can be smaller than the second local minimum MIN_2 and therefore the first local minimum MIN_1 defines a global minimum in such other case.

The invention claimed is:

1. A solenoid drive for a starter, comprising:

a ferromagnetic housing having a coil receiving chamber axially limited by a first face side wall and an opposing second face side wall;

a cylindrical coil arrangement having at least one electric coil, the coil arrangement being arranged in the coil receiving chamber and coaxially surrounding a cylindrical coil interior space;

a ferromagnetic plunger stop having a central region projecting axially in the coil interior space;

a ferromagnetic plunger arranged at the housing opposing the plunger stop, the plunger projecting axially into the coil interior space and being arranged so as to be adjustable axially bi-directionally relative to the housing between an active position, which is proximal with respect to the central region, and a passive position, which is distal with respect to the central region; and a ferromagnetic bypass device extending in a circumferential direction and arranged coaxially with respect to the coil arrangement and radially within the at least one electric coil;

wherein the bypass device is fixed relative to the housing and spaced apart axially from the first and second face side walls in all positions of the plunger; and wherein in the passive position, the plunger projects axially into the bypass device such that an axial overlap between the plunger and the bypass device is defined.

2. The solenoid drive according to claim 1, wherein:

when the coil arrangement is electrically energized for moving the plunger from the passive position to the active position, a magnetic attracting force operates on the plunger to move the plunger from the passive position to the active position; and an axial position of the bypass device axially between the first and second face side walls, an axial height of the bypass device, and the axial overlap are coordinated in such a way that said magnetic attracting force has a first local maximum at the passive position, decreases from said first local maximum to a local minimum, and then increases from said local minimum to a second local maximum.

3. The solenoid drive according to claim 2, wherein said local minimum is within a first half or within a first third of a movement of the plunger between the passive position and the active position (AS).

4. The solenoid drive according to claim 1, wherein the axial overlap is less than 50% of an axial height of the bypass device.

5. The solenoid drive according to claim 1, wherein the axial overlap is less than three times of a radial wall thickness of the bypass device.

6. The solenoid drive according to claim 1, wherein the axial overlap is less than 5 mm plus half of a radial wall thickness of the bypass device.

7. The solenoid drive according to claim 1, wherein the bypass device is ring-shaped and has in the circumferential direction a constant radial wall thickness and a constant axial height.

8. The solenoid drive according to claim 1, wherein one of:

the bypass device has at least one winding made from a ferromagnetic wire, or is formed therefrom;

the bypass device has a plurality of ferromagnetic bypass elements distributed in the circumferential direction; or the bypass device has a ferromagnetic ring body extending in the circumferential direction continuously or with a single interruption.

9. The solenoid drive according to claim 1, wherein the bypass device is at a respective axial distance from the first and second face side walls that is at least 20% of an axial length of the coil receiving chamber.

10. The solenoid drive according to claim 1, wherein one of:

the bypass device is arranged closer to the second face side wall than to the first face side wall such that an axial distance between the bypass device and the first face side wall is bigger than an axial distance between the bypass device and the second face side wall; or the bypass device is arranged closer to the first face side wall than to the second face side wall such that an axial distance between the bypass device and the second face side wall is bigger than an axial distance between the bypass device and the first face side wall.

11. The solenoid drive according to claim 1, wherein the central region of the plunger stop has an axial distance from the bypass device.

12. The solenoid drive according to claim 11, wherein the axial distance between the central region and the bypass device is bigger than the axial overlap.

13. The solenoid drive according to claim 11, wherein the axial distance between the central region and the bypass device is smaller than an axial height of the bypass device.

14. The solenoid drive according to claim 1, wherein:

the coil arrangement has a cylindrical coil carrier onto which the at least one coil is wound radially on an outside of the coil carrier; and the bypass device is in contact with said coil carrier and is arranged radially on an inside of the at least one coil.

15. The solenoid drive according to claim 14, wherein one of:

the bypass device is inserted into a reception provided radially on an inside of the coil carrier such that an outer portion of the coil carrier is radially between the bypass device and the at least one coil;

the bypass device is inserted into a reception provided radially on the outside of the coil carrier such that an inner portion of the coil carrier is radially between the bypass device and the coil interior space; or the bypass device is integrated into the coil carrier such that the outer portion of the coil carrier is radially between the bypass device and the at least one coil and that the inner portion of the coil carrier is radially between the bypass device and the coil interior space.

16. The solenoid drive according to claim 1, wherein the plunger is guided in an axially adjustable manner radially on an inside of a cylindrical guide sleeve arranged coaxially on an inside of the coil arrangement and which extending from a first axial end through the coil interior space and beyond a second axial end into a guide region of the housing through which the plunger passes.

17. A method for operating the solenoid drive of claim 1, comprising:

steadily reducing a magnetic attracting force operating on the plunger to move the plunger from the passive position into the active position during a first phase of a movement from the passive position; and steadily increasing the magnetic attracting force during a second phase of the movement.

18. A solenoid drive for a starter, comprising:

a ferromagnetic housing having a coil receiving chamber axially limited by a first face side wall and an opposing second face side wall;

a cylindrical coil arrangement having at least one electric coil, the coil arrangement being arranged in the coil receiving chamber and coaxially surrounding a cylindrical coil interior space;

a ferromagnetic plunger stop having a central region projecting axially in the coil interior space;

a ferromagnetic plunger arranged at the housing opposing the plunger stop, the plunger projecting axially into the coil interior space and being arranged so as to be adjustable axially bi-directionally relative to the housing between an active position, which is proximal with respect to the central region, and a passive position, which is distal with respect to the central region; and a ferromagnetic bypass device extending in a circumferential direction and arranged coaxially with respect to the coil arrangement and radially within the at least one electric coil;

wherein the bypass device is spaced apart axially from the first and second face side walls;

wherein in the passive position, the plunger projects axially into the bypass device such that an axial overlap between the plunger and the bypass device is defined; and wherein the central region of the plunger stop has an axial distance from the bypass device.

19. The solenoid drive according to claim 18, wherein:

the coil arrangement has a cylindrical coil carrier onto which the at least one coil is wound radially on an outside of the coil carrier; and the bypass device is in contact with said coil carrier and is arranged radially on an inside of the at least one coil.

20. A solenoid drive for a starter, comprising:

a ferromagnetic housing having a coil receiving chamber axially limited by a first face side wall and an opposing second face side wall;

a cylindrical coil arrangement having at least one electric coil, the coil arrangement being arranged in the coil receiving chamber and coaxially surrounding a cylindrical coil interior space;

a ferromagnetic plunger stop having a central region projecting axially in the coil interior space;

a ferromagnetic plunger arranged at the housing opposing the plunger stop, the plunger projecting axially into the coil interior space and being arranged so as to be adjustable axially bi-directionally relative to the housing between an active position, which is proximal with respect to the central region, and a passive position, which is distal with respect to the central region; and a ferromagnetic bypass device extending in a circumferential direction and arranged coaxially with respect to the coil arrangement and radially within the at least one electric coil;

wherein the bypass device is spaced apart axially from the first and second face side walls;

wherein in the passive position, the plunger projects axially into the bypass device such that an axial overlap between the plunger and the bypass device is defined; and wherein one of:

the axial overlap is less than 50% of an axial height of the bypass device;

the axial overlap is less than three times of a radial wall thickness of the bypass device; or the axial overlap is less than 5 mm plus half of a radial wall thickness of the bypass device.

* * * * *